United States Patent [19]

Yamane

[11] 4,168,408

[45] Sep. 18, 1979

[54] LIMIT SWITCH UTILIZING AN IMPROVED ACTUATOR

[75] Inventor: Norihito Yamane, Nagaokakyo, Japan

[73] Assignee: Omron Tateisi Electronics Company, Kyoto, Japan

[21] Appl. No.: 856,774

[22] Filed: Dec. 2, 1977

[30] Foreign Application Priority Data

Dec. 7, 1976 [JP] Japan ..... 51/164627[U]

[51] Int. Cl.[2] ..... H01H 3/16

[52] U.S. Cl. ..... 200/47; 200/153 T

[58] Field of Search ..... 200/47, 153 T, 330

[56] References Cited

U.S. PATENT DOCUMENTS

| | | | |
|---|---|---|---|
| 2,331,997 | 10/1943 | Mensenkamp | 200/330 X |
| 2,428,832 | 10/1947 | Charbonneau | 200/47 X |

FOREIGN PATENT DOCUMENTS

| | | | |
|---|---|---|---|
| 1089037 | 9/1960 | Fed. Rep. of Germany | 200/47 |
| 2432821 | 1/1976 | Fed. Rep. of Germany | 200/330 |
| 50-5561 | of 1975 | Japan . | |
| 51-29960 | of 1976 | Japan . | |

*Primary Examiner*—Herbert F. Ross

[57] ABSTRACT

A limit switch comprising a switch enclosure, a snap action switch, and an operating head. An actuator slidably mounted in the operating head is provided with a wing which prevents the rotation of the actuator.

7 Claims, 4 Drawing Figures

LIMIT SWITCH UTILIZING AN IMPROVED ACTUATOR

BRIEF SUMMARY OF INVENTION

This invention relates to an actuating means in a limit switch which is usually used to control various kinds of machine tools.

In some types of actuators in which the top portion has directivity, such as a roller type and bevel type, it is required that the actuator be kept from rotating from a set direction to meet a dog correctly. In a prior art limit switch, an actuator is provided with a flange portion having two sides cut to engage with a slot for preventing a rotation of the actuator. The flange portion is made in one body with the actuator by machining, therefore, the flange portion can not be made large enough, and the machining is expensive.

Accordingly, an object of the invention is to provide a limit switch having an improved actuator which is prevented from rotating.

Another object of the invention is to provide an improved actuator which is strong to resist shock imparted by a dog.

An additional object of the invention is to provide an improved actuator which can be manufactured easily and cheaply.

These and other advantages are obtained through the provision of an actuator having a wing on its bottom part, which is guided by guides for preventing a rotation of the actuator. In a particularly preferred form of the invention, two rod shaped guides are provided in the operating head for guiding the wing, and two return springs are further provided around the rod shaped guides for urging the actuator upwardly through the wing.

The nature of the invention, including the foregoing and the other objects and novel features, will be more fully appreciated from the following detailed description when taken in conjunction with the accompanying drawings.

BRIEF DESCRIPTION OF THE DRAWINGS

FIG. 4 is a perspective view of a roller actuator which may be used in lieu of the wedge shaped actuator shown in FIGS. 1-3.

DESCRIPTION OF THE PREFERRED EMBODIMENTS

Figure 1:
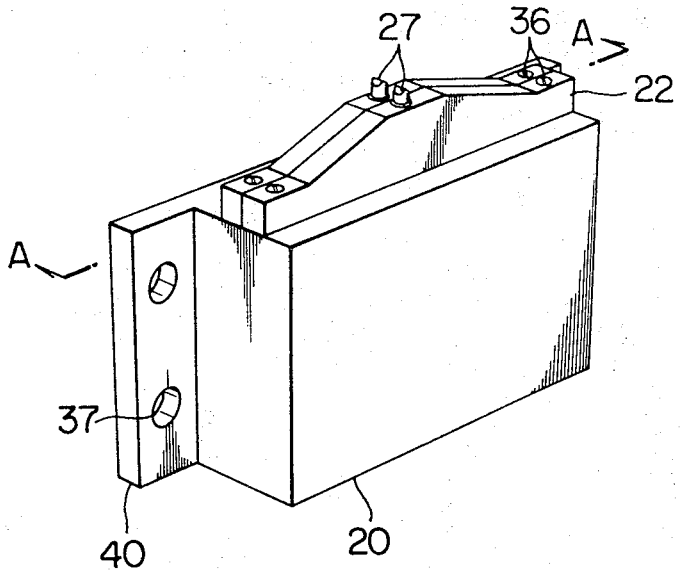
FIG. 1 is a perspective view of an improved limit switch.
Figure 2:
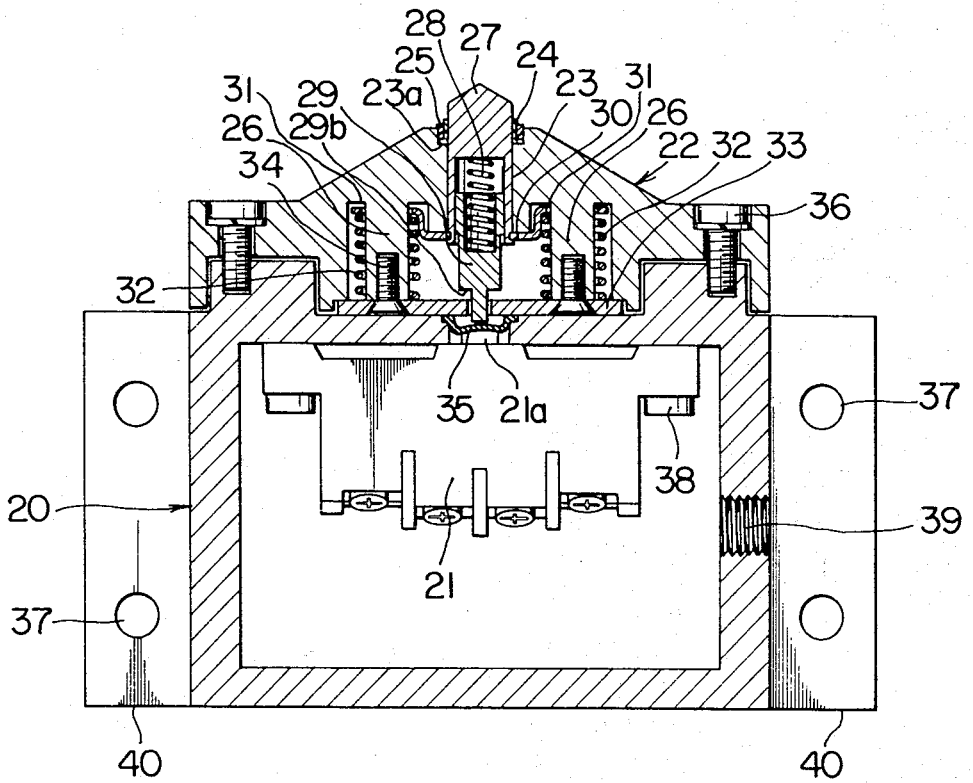
FIG. 2 is a sectional view taken along line A—A in FIG. 1.
Figure 3:
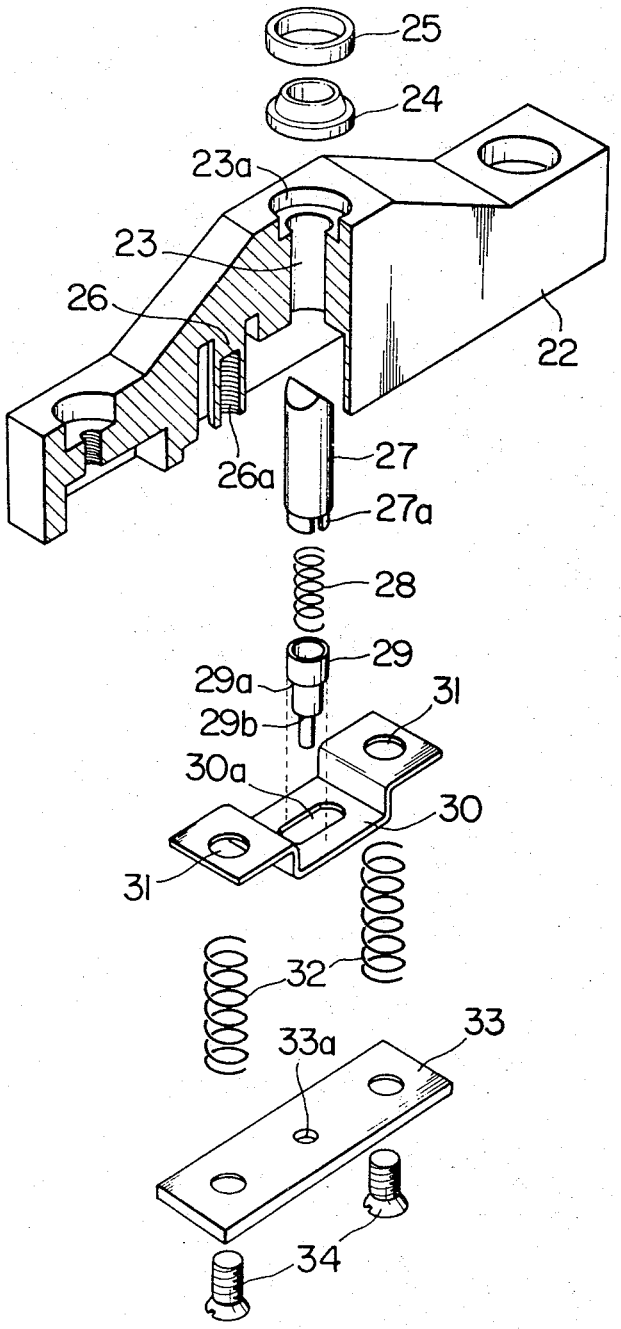
FIG. 3 is a exploded view of an operating head shown in FIG. 1.

Referring to the drawings FIG. 1 through FIG. 3, a limit switch embodying the present invention comprises a switch enclosure 20, a snap action switch 21, and an operating head 22.

The snap action switch 20 is mounted in the switch enclosure 20 which is made of Aluminum alloy. The operating head 22 is mounted on a upper surface of the switch enclosure 20 for actuating the snap action switch 21. The switch enclosure 20 has flange portions 40 in which holes 37 are bored for mounting screws, and has a threaded bore 39 to receive a wire conduit. A hole 23 is formed at the center of the operating head 22. A dust seal 24 and a retaining ring 25 are inserted in a upper portion **23*a* of the hole 23. Beside the hole 23, rod shaped guides 26 having threaded bores 26*a* are formed in parallel with the hole 23. An actuator 27 having a wedge shaped top portion (FIGS. 1-3) or having a roller on the top (FIG. 4) is slidablly inserted in the hole 23. The actuator 27 has a wing 30 calked or welded on the bottom of the actuator 27 so that the actuator 27 is urged upwardly by springs 32 that are placed around the guides 26. In a hole drilled in the bottom of the actuator 27, a plunger 29 is arranged with an actuator spring 28 urging the plunger 29 downwardly. The wing 30 forms a retainer for the plunger 29 which has a first stepped portion 29*a* for seating on a edge of a slot 30*a* formed on the wing 30. The, the wing 30 has two holes 31 at opposite ends of wing 30 in which the rod shaped guides 26** are slidably fitted.

A plate 33 screwed up on the bottom of the guides 26 holds the return springs 32. One end of the plunger 29 projects downwardly through a center hole **33*a* of a plate 33 to actuate the snap action switch 21. The plate 33 also forms a stopper for the plunger 29 by a second stepped portion 29*b* meeting with the periphery of the hole 33*a*** when the actuator is pressed down to excess.

When a dog (not shown) moves in contact with the actuator 27, the actuator 27 pushes down the plunger 29 through the actuator spring 28. One end of the plunger 29 pushes down a button **21*a* of the snap action switch 21 through a oil seal 35. If the actuator 27 is pushed down to excess, the plunger 29 is stopped by the plate 33. The excessive motion of the actuator 27 is absorbed by the actuator spring 28 for protecting the snap action switch 21**.

As shown in the above, a limit switch embodying the present invention has an actuator which is kept from rotating for secure operation. The limit switch is strong resisting shocks imparted by a dog, is easy to manufacture, and is of low cost.

Although a particular embodiment of the invention has been described in detail with reference to the accompanying drawings, it is to be understood that the invention is not limited to the precise embodiment disclosed and that various changes and modifications may be readily effected by one skilled in the art without departing from the spirit or scope of the invention which is defined solely by the appended claims.

What is claimed is:

1. A limit switch comprising:

a switch enclosure;

a snap action switch placed in said switch enclosure;

an operating head mounted on said switch enclosure for actuating said snap action switch, said operating head having an actuator;

a wing fixed to the bottom of said actuator, said wing having a pair of apertures through which a pair of guides formed in said operating head respectively pass for preventing a rotation of said actuator; and, a pair of springs operatively provided about said guides for urging said wing and actuator upwardly.

2. A limit switch as in claim 1, wherein said actuator includes a plunger and an actuator spring urging said plunger downwardly, said plunger having a stepped portion, said limiting switch further comprising a fixed plate cooperating with said stepped portion for limiting downward movement of said plunger.

3. A limit switch as in claim 1, wherein said pair of apertures are provided at opposite ends of said wing.

4. A limit switch as in claim 1, wherein said actuator has a beveled top portion.

5. A limit switch as in claim 1, wherein said actuator is provided with a roller on its top portion.

6. A limit switch comprising:

a switch enclosure;

a snap action switch mounted in said enclosure;

an operating head mounted on said switch enclosure for actuating said snap action switch, said operating head including an actuator projecting from said head, a plunger axially aligned with said actuator and displaceable upon displacement of said actuator to actuate said snap action switch, means for limiting the displacement of said plunger, a spring mounted between said actuator and plunger for urging said plunger downwardly with respect to said actuator and for absorbing excess movement of said actuator when said limiting means prevents further displacement of said plunger, a wing fixed to the bottom of said actuator through which said plunger passes, a pair of wing guides guiding said wing and preventing it from rotating to prevent rotation of said actuator and, a pair of springs provided one each on said guides for biasing said wing and said actuator away from said snap action switch.

7. A limit switch as in claim 6 wherein said means for limiting comprises a stepped portion on said plunger and a plate through which a portion of said plunger passes during displacement, said plate engaging with said stepped portion to prevent further plunger displacement.

* * * * *